US006951379B2

(12) United States Patent
Sarmast et al.

(10) Patent No.: US 6,951,379 B2
(45) Date of Patent: Oct. 4, 2005

(54) PRINT HEAD CHARGE SHIELD

(75) Inventors: Sam Sarmast, Vancouver, WA (US); Wen-Li Su, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/411,048

(22) Filed: Apr. 9, 2003

(65) Prior Publication Data

US 2004/0201640 A1 Oct. 14, 2004

(51) Int. Cl.[7] ..... B41J 29/393
(52) U.S. Cl. ..... 347/19
(58) Field of Search ..... 347/19, 76, 75, 347/73, 81

(56) References Cited

U.S. PATENT DOCUMENTS 3,852,768 A 12/1974 Carmichael et al.
3,977,010 A 8/1976 Erickson et al.
4,333,083 A 6/1982 Aldridge
4,489,335 A * 12/1984 Watanabe et al. ..... 347/19
4,651,163 A * 3/1987 Sutera et al. ..... 347/76

FOREIGN PATENT DOCUMENTS

JP 60253554 12/1985
JP 62063891 * 9/1998 ..... 347/74

OTHER PUBLICATIONS

"Feedback for Synchronized Pressure Jet Using Optical Sensor", IBM Technical Diclosure Bulletin vol. 16, No. 12, May 1974, pp. 3877, 3878.*
British Search Report dated May 28, 2004.

* cited by examiner

*Primary Examiner*—Thinh Nguyen
*Assistant Examiner*—Julian D. Huffman

(57) ABSTRACT

A printer according to the present techniques includes a print head having at least one nozzle for ejecting an ink drop and a sensing element for detecting the ink drop. The print head includes a charge shield for imparting an electrical charge into the ink drop during ejection from the nozzle and for shielding electrical noise generated in the print head.

4 Claims, 5 Drawing Sheets

PRINT HEAD CHARGE SHIELD

BACKGROUND

A typical printer includes one or more print heads for applying ink onto paper. A typical print head includes a set of nozzles and a firing mechanism for ejecting ink drops through the nozzles. Examples of firing mechanisms include piezo-electric crystals that squeeze out ink drops through the nozzles and heating elements that boil out ink drops through the nozzles.

It is often desirable to provide a printer with an ink drop detector. An ink drop detector may be used to detect whether ink drops are being ejected from individual nozzles of a print head. For example, an ink drop detector may be used to determine whether nozzles are clogged and would benefit from cleaning or whether individual nozzles have failed permanently.

One type of prior ink drop detector that may be employed in printers is an electrostatic drop detector. An electrostatic drop detector may include a conductive surface that functions as a charging element and a sensing element. A print head may be positioned to fire ink drops at the conductive surface. A high voltage may be applied to the conductive surface to create a relatively strong electric field that induces an electrical charge into the ink drops ejected from the print head. The charged ink drops that strike the conductive surface usually impart an electrical pulse into the conductive surface. Signal processing may be used to derive a drop detection indicator from the electrical pulses imparted by the charged ink drops onto the conductive surface.

The firing mechanism in a typical prior print head may create electrical noise that coincides with ink drop ejection. The electrical noise caused by firing pulses in a print head may be mistaken for charged ink drops by the electrostatic drop detector and give false indications of ink drop ejection.

In addition, the electrical noise used by firing pulses in a print head may increase the signal-to-noise ratio which leads to more expensive detection circuitry and more complex signal processing.

SUMMARY OF THE INVENTION

A printer according to the present techniques includes a print head having at least one nozzle for ejecting an ink drop and a sensing element for detecting the ink drop. The print head includes a charge shield for imparting an electrical charge into the ink drop during ejection from the nozzle and for shielding electrical noise generated in the print head. The charge shield in the print head increases the charge induced into the ink drop while shielding the separate sensing element from electrical noise.

BRIEF DESCRIPTION OF THE DRAWINGS

The present invention is described with respect to particular exemplary embodiments thereof and reference is accordingly made to the drawings in which.

DETAILED DESCRIPTION

Figure 1:
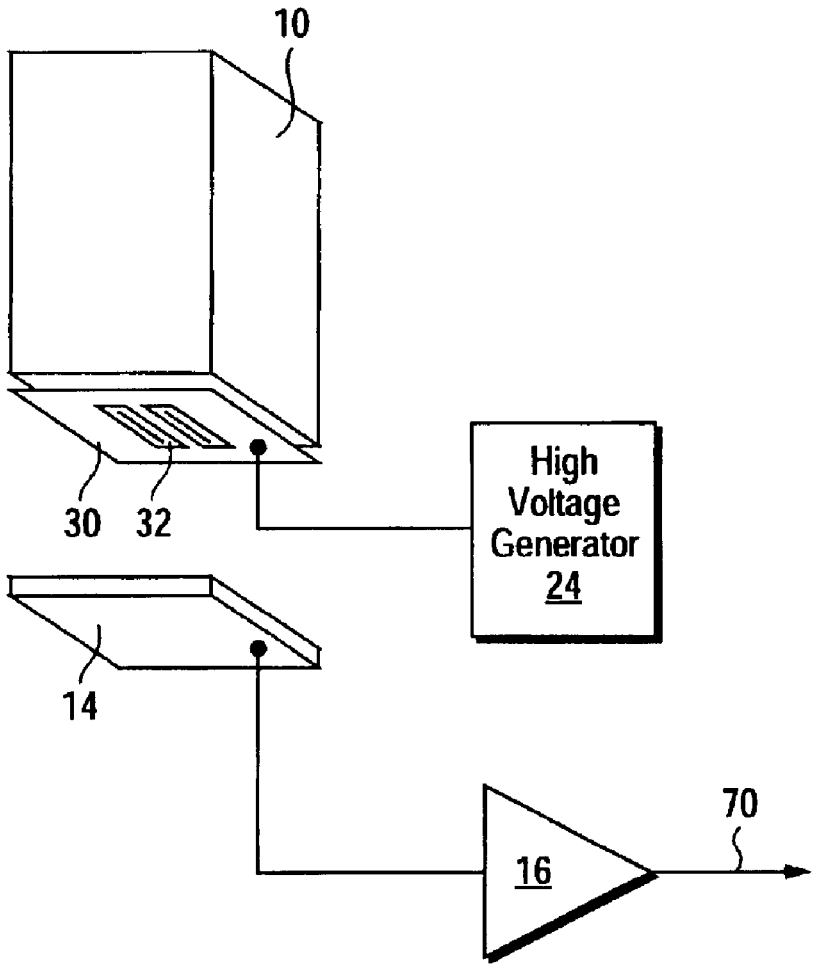
FIG. 1 shows a print head that includes a charge shield according to the present techniques.

FIG. 1 shows a print head 10 that includes a charge shield 30 according to the present techniques. The print head 10 includes a set of nozzles 32 and a firing mechanism for ejecting ink drops from the nozzles 32. The ink drops ejected from the nozzles 32 strike a sensing element 14. The charge shield 30 in this embodiment is mounted on the print head 10.

The charge shield 30 is applied with a high voltage by a high voltage generator 24. The high voltage on the charge shield 30 imparts an electrical charge into the ink drops ejected from the nozzles 32. Each charged ink drop that strikes the sensing element 14 imparts an electrical pulse into the sensing element 14. The electrical pulses imparted into the sensing element 14 are amplified by a sense amplifier 16 to provide detection signal 70.

The charge shield 30 provides an AC path to ground for shielding electrical noise that may be generated in the print head 10. For example, electrical noise may be generated by the ink drop firing mechanism in the print head 10. The AC path to ground provided by the charge shield 30 reduces the electrical noise in the print head 10 that would otherwise reach the sensing element 14 and influence the electrical state of the sensing element 14. For example, the charge shield 30 attenuates firing noise in the print head 10, thereby reducing the magnitude of pulses in the sensing element 14 that can be mistaken for an ink drop from a clogged nozzle.

The charge shield 30 may be a conductive metal plate, a metal foil, a copper tape, etc.

The charge shield 30 may be mounted on the print head 10 using, for example, an adhesive, fasteners, etc. Alternatively, the charge shield 30 may be mounted on a carriage for the print head 10.

Figure 2:
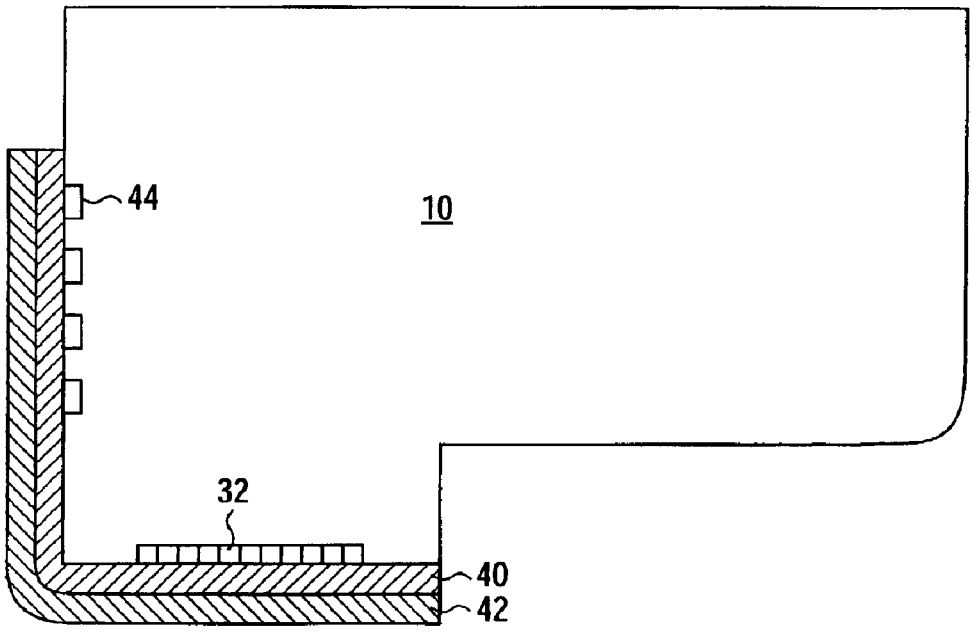
FIG. 2 shows another embodiment of a print head according to the present techniques.

FIG. 2 shows another embodiment of the print head 10 according to the present techniques. The print head 10 in this embodiment includes a flexible ribbon cable that includes two layers—a layer 40 and a layer 42. The layer 42 in the region near the nozzles 32 holds a charge shield that charges the ink drops ejected from the nozzles 32 and that shields the electrical noise generated in the print head 10. The charge shield may be disposed on either the upper or lower surface of the layer 42 or may be contained within the layer 42. The layer 42 also includes a set electrical signal lines for applying a high voltage to the charge shield. The layer 40 provides data signals to a set of electrical contacts 44 of the print head 10.

Figure 3:
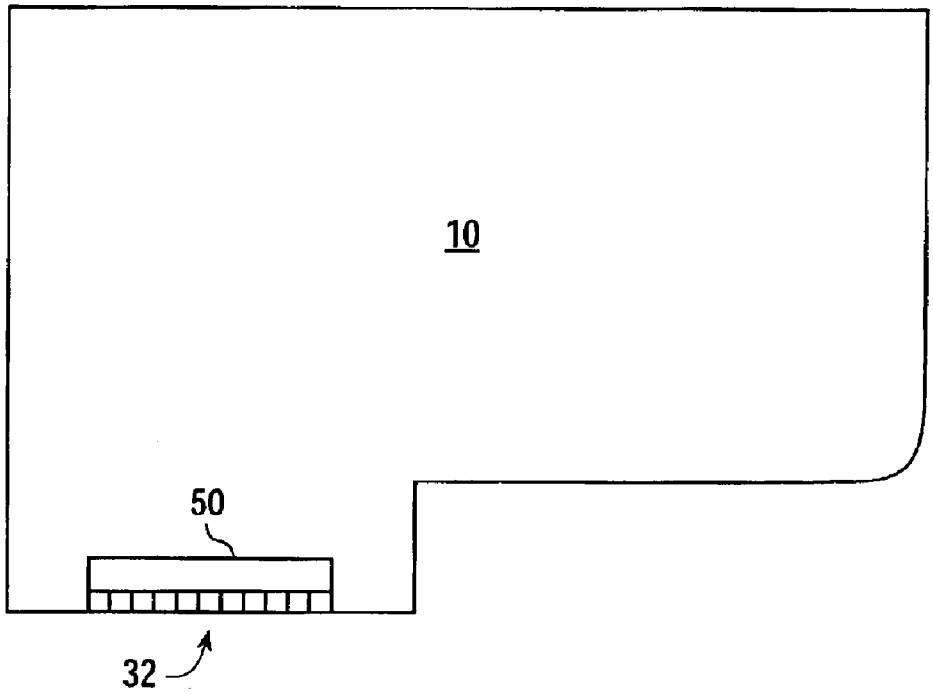
FIG. 3 shows yet another embodiment of a print head according to the present techniques.

FIG. 3 shows yet another embodiment of the print head 10 according to the present techniques. The print head 10 in this embodiment includes a silicon structure 50 that includes electrical elements for firing the nozzles 32. For example, the silicon structure 50 may include thermal heating elements and associated drive electronics for firing individual heating elements. In this embodiment, the charge shield is incorporated into the silicon structure 50.

Figure 4:
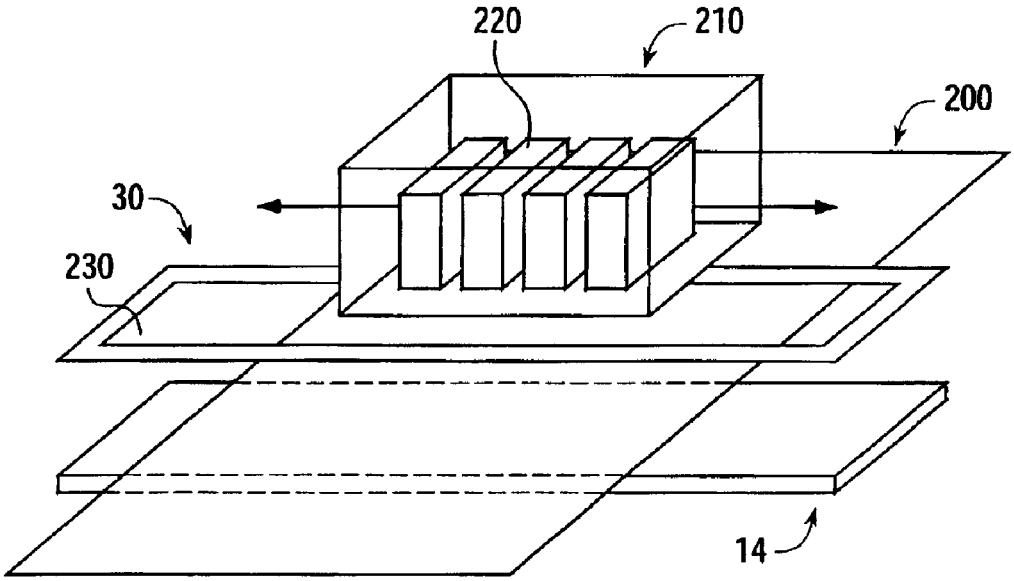
FIG. 4 shows another embodiment of a charge shield according to the present techniques.

FIG. 4 shows another embodiment of the charge shield 30 according to the present techniques. The charge shield 30 in this embodiment encompasses the range of movement of a carriage 210 across a paper 200. The carriage 210 includes a set of print heads 220 each having nozzles for ejecting ink drops onto the paper 200 through an opening 230 in the charge shield 30. The sensing element 14 in this embodiment also encompasses the range of the movement of the carriage 210.

The high voltage electronics for the charge shield in any of the above embodiments may be integrated into an analog ASIC on the carriage for the print head 10.

Figure 5:
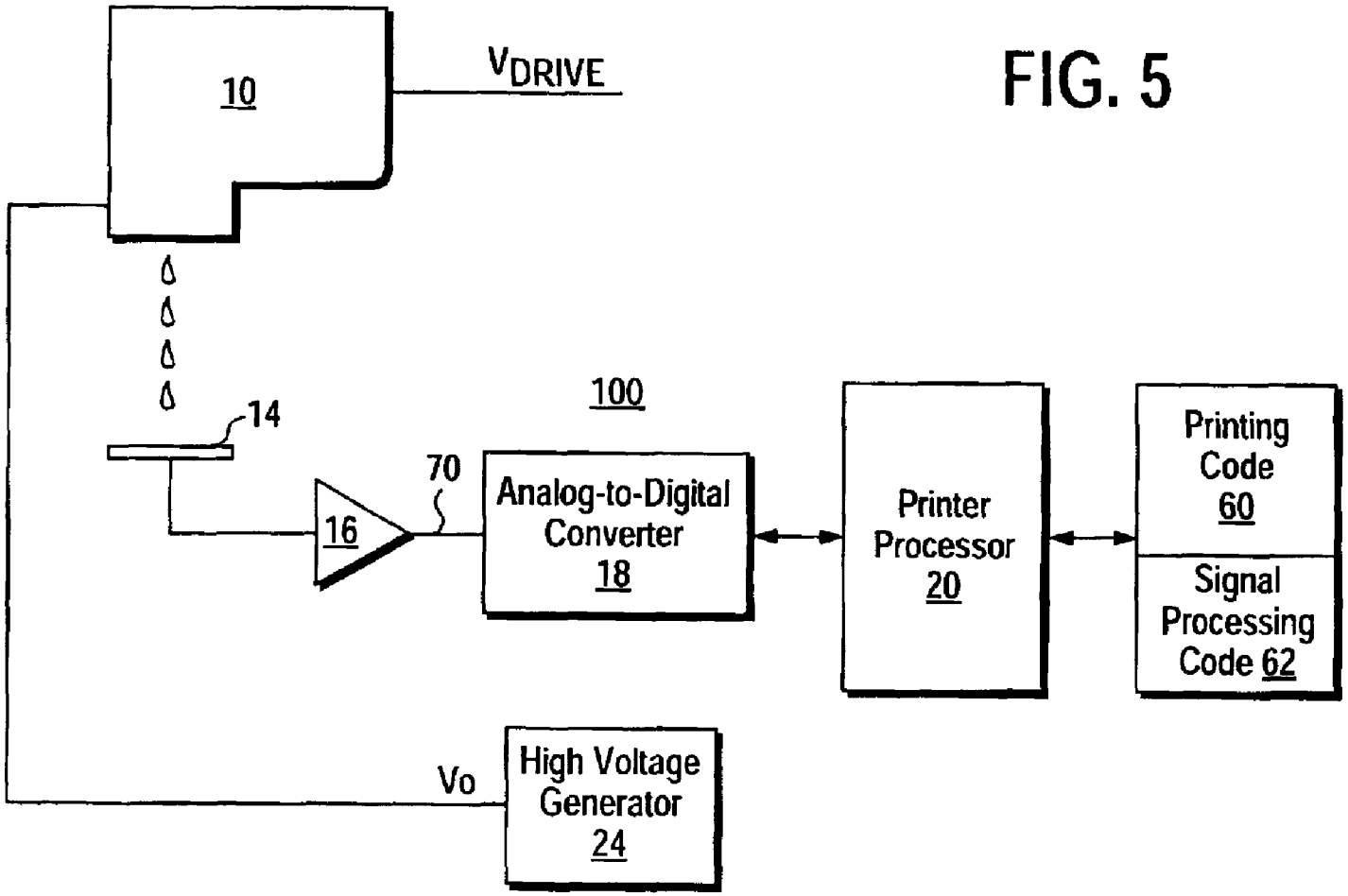
FIG. 5 shows a printer that incorporates electrostatic drop detection according to the present teachings.

FIG. 5 shows a printer 100 that incorporates electrostatic drop detection according to the present teachings. The print head 10 is shown positioned opposite the sensing element 14 at a distance of several millimeters during an ink drop detection cycle. The sensing element 14 may be disposed in an existing service station in the printer 100. The charge shield in the print head 10 is supplied with a voltage potential V0 by the high voltage generator 24. The voltage potential V0 may be a DC voltage or an AC voltage. A drive voltage $V_{DRIVE}$ is applied for actuating the ink drop firing mechanisms in the print head 10. The voltage potential $V_{DRIVE}$ is relatively low compared to V0. For example, in one embodiment, $V_{DRIVE}$ is approximately 5 volts and the high voltage generator 24 applies a V0 of approximately 100 volts. The high voltage V0 creates in a relatively high electric field near the nozzles 32 of the print head 10, i.e. at the location of the charge shield in the print head 10.

The print head 10 ejects a series of ink drops 12 during an ink drop detection cycle. The relatively high electric field near the nozzles of the print head 10 causes the accumulation of electrical charge in the ink drops 12 as they shear away from a nozzle of the print head 10. As each of the ink drops 12 separates from the print head 10 it retains its accumulated electrical charge. Each of the ink drops 12 transports its induced charge to the sensing element 14.

Each of the charged ink drops 12 imparts a spike or pulse of electrical charge onto the sensing element 14 as it makes contact. These spikes or pulses on the sensing element 14 are coupled to an input of the sense amplifier 16. The sense amplifier 16 amplifies the pulses and provides filtering.

In one embodiment, the ink drops 12 are fired in a series of bursts having a predetermined frequency or pattern of frequencies. The sense amplifier 16 is tuned to amplify signals from the sensing element 14 at the frequency or frequencies of the predetermined pattern. The detection signal 70 from the sense amplifier 16 is provided to an analog-to-digital converter 18 which generates a digitized version. This digitized version of the detection signal 70 is provided to the printer processor 20 which executes signal processing code 62.

The printer processor 20 when executing the signal processing code 62 performs a digital signal processing function on the digitized version of the detection signal 70. The digital signal processing function performed by the printer processor 20 provides a drop detection value that is then used to characterize ink drops ejected from the print head 10 during an ink drop detection cycle. One characteristic which the drop detection value is used to determine is whether any ink drops were ejected during the ink drop detection cycle.

The drop detection value generated by the print processor 20 is proportional to the number of drops fired from the print head 10. The drop detection value is also proportional to the volume of the ink drops ejected and the velocity of the ink drops that were ejected.

The printer processor 20 compares the drop detection value or values obtained from a ink drop detection cycle to a stored representation of drop detection values to determine the number of drops fired by the print head 10 during the ink drop detection cycle. For example, if the drop detection value from an ink drop detection cycle is within a tolerance value of a stored drop detection value corresponding to N ink drops, then it can be concluded that N ink drops struck the sensing element 14 during bursts of a detection cycle. If the drive control electronics for the print head 10 actuated N firings per burst then it can be concluded that the particular nozzle of the print head 10 under test is functioning properly. If, on the other hand, the drive control electronics actuated N firings and the resulting drop detection value is significantly below the stored drop detection value corresponding to N ink drops then it can be concluded that the particular nozzle under test is not functioning properly.

The drop detection values determined by the printer processor 20 may be used for rendering a go/no-go decision on each of the nozzles in the print head 10. In one embodiment, the printer processor 20 tests a few nozzles on the fly at the end of a print cycle on a page. If the drop detection value from a particular ink drop detection cycle is too low then the printer 100 may apply the print head 10 to the service station in the printer. If after cleaning several times the particular nozzle or nozzles are still bad then the printer processor 20 may adjust its printing algorithm embodied in the printing code 60 to compensate for the bad nozzle or provide an error indication to a user of the printer that the print head 10 should be replaced.

The drop detection values may be used for characterizing the individual nozzles of the print head 10 in order to enhance gray scale or color resolution. The drop detection value may be used for adjusting the drive voltages to individual ones or groups of nozzles in a thermal print head in order to enhance the life of the heating elements contained therein.

The sensing element 14 may be contained in a trough or spittoon that accepts test ink drops fired from the print head 10. The sense amplifier 16 may be may be implemented in an application specific integrated circuit that is encapsulated by an insulating layer in the spittoon. The sensing element 14 may be a metal layer disposed on top of the insulating layer. Alternatively, the sensing element 14 may be positioned beneath a paper path in a printing area opposite the print head 10 and may be constructed of a conductive pad of foam or a metallic or a conductive plastic member.

The foregoing detailed description is provided for the purposes of illustration and is not intended to be exhaustive or to limit the invention to the precise embodiment disclosed. Accordingly, the scope of the present invention is defined by the appended claims.

What is claimed is:

1. A print head comprising a firing mechanism that generates an electrical noise and further comprising a charge shield for imparting an electrical charge into an ink drop during ejection from a nozzle of the print head and for shielding the electrical noise.

2. The print head of claim 1, wherein the charge shield is attached to the print head.

3. The print head of claim 1, wherein the charge shield is integrated into a flexible cable attached to the print head.

4. The print head of claim 1, wherein the charge shield is integrated into a silicon structure in the print head that includes a firing mechanism.

* * * * *